United States Patent [19]

Jones

[11] Patent Number: 4,490,110

[45] Date of Patent: Dec. 25, 1984

[54] PLENUM ARRANGEMENT

[76] Inventor: William R. Jones, 244 Hampshire Dr., Chalfont, Pa. 18914

[21] Appl. No.: 496,588

[22] Filed: May 20, 1983

[51] Int. Cl.[3] ..... F27B 5/04

[52] U.S. Cl. ..... 432/205; 432/194; 432/152

[58] Field of Search ..... 432/198, 152, 145, 148, 432/189, 190, 192, 194, 196, 206, 238, 205; 373/77

[56] References Cited

U.S. PATENT DOCUMENTS

| | | | |
|---|---|---|---|
| 1,651,380 | 12/1927 | Dressler | 432/194 |
| 2,311,350 | 2/1943 | Richardson | 432/175 |
| 2,548,485 | 4/1951 | Lubbock | 432/238 |
| 3,537,405 | 11/1970 | Verhoeven | 432/152 |
| 3,565,410 | 2/1971 | Scherff | 432/205 |
| 4,212,633 | 7/1980 | Krieder et al. | 432/194 |
| 4,280,807 | 7/1981 | Smith, Jr. et al. | 432/205 |
| 4,325,694 | 4/1982 | Bergman | 432/205 |
| 4,395,832 | 8/1983 | Jones et al. | 432/77 |

*Primary Examiner*—Henry C. Yuen

*Attorney, Agent, or Firm*—William E. Cleaver

[57] ABSTRACT

The present invention provides, among other things, a plenum which is formed around the hot zone chamber of a vacuum furnace and which has a common wall with the hot zone chamber. The present arrangement includes having a plurality of apertures formed in the common wall and a plurality of baffles, or deflecting means, secured to the common wall within the chamber of the plenum. The baffles, or deflecting means, are formed to be angular with respect to the common wall and each deflecting means is disposed and formed to deflect gas (in all likelihood, inert gas), passing through the plenum, into and through an associated aperture and thereby into the hot zone chamber. By using the baffles, the inert gas, which is fed into the hot zone chamber from the plenum, is so fed with improved and significant uniformity.

1 Claim, 6 Drawing Figures

PLENUM ARRANGEMENT

BACKGROUND

Work pieces, for instance items which are to be annealed, hardened, sintered, etc., are heated to extremely high temperatures in a vacuum furnace. A vacuum furnace is used to heat such items for a number of reasons. For instance, if such items were heated in the atmosphere, the items would become oxidized and that would be unacceptable. However, after the items have been "heat treated" in a vacuum furnace, there is a need to cool such items so that when they are removed from the vacuum furnace, they will no longer be at high temperatures and, therefore, will no longer oxidize in the course of being so removed. In some instances a rapid quenching, or cooling, is desirous to effect certain characteristics in the workpiece. For instance in heat treating certain grades of stainless steel and in the hardening of tool steels, rapid quenching is desirous.

Accordingly vacuum furnaces have, in the prior art, provided arrangements for quenching or cooling the workpiece. A popular technique and the necessary hardware to effect that technique is described in connection with a discussion of FIG. 1 and consists of a network of pipes connected to a manifold means. Inert gas is pumped into the manifold means under pressure when quenching is to take place. The inert gas flows from the manifold means, through the various pipes into the hot zone chamber of the vacuum furnace. While this arrangement has been satisfactory and is in great use, it does have some serious infirmities. The infirmities lie in two major areas although, indeed, there are lesser infirmities as well. When the system needs to be repaired, for instance because one or more of the heating elements in the hot zone chamber, wears (due to thermal expansion and contraction) and breaks, the entire pipe assembly must be removed in order to be able to get the hot zone assembly out of the vacuum furnace chamber. During such maintenance efforts in the prior art, the pipes, which are brittle, break. In addition, in the prior art arrangement, the inert gas flows into the hot zone chamber in a non-uniform way and such non-uniformity requires the need of excess amounts of inert gas to be certain that all of the workpiece is cooled properly. In my U.S. Pat. No. 4,395,832, entitled "A Gas Duct Arrangement For A Vacuum Furnace," I teach a plenum which overcomes the problems related to pipes breaking during maintenance, and which provides substantially uniform inert gas flow into the hot zone chamber and, therefore, to the workpiece for cooling. While the structure that I teach in my above mentioned patent, does provide an improved means for introducing inert gas into the hot zone chamber, no structure is without some room for improvement. In field use of my structure, described in U.S. Pat. No. 4,395,832, I have found that the uniformity of gas flow into the hot zone chamber of the vacuum furnace is decidedly improved over the prior art, but I have also found that if I add baffles as described in this patent application, the uniformity of the gas flow is increased even more.

SUMMARY

In accordance with the present invention, a plenum is created around the outside wall of a hot zone chamber of a vacuum furnace. The bottom wall of the plenum is common with the outside wall of the hot zone chamber. Through thus common wall there is formed a plurality of apertures and in each of the apertures, there is located a nozzle. The chamber of the plenum is sealed against the ambient atmosphere. In addition, in the chamber of the plenum there is mounted a plurality of baffles, or gas deflecting members, with each being associated with at least one aperture so that as gas passes through the plenum, a portion of it is intercepted by the baffles and is deflected through an aperture or apertures (associated with the baffles) into the hot zone chamber in response to the pressure differential between the hot zone chamber and the plenum. The baffles cause uniformity of gas flow into the hot zone chamber and therefore to the workpiece located in the hot zone chamber.

The features and objects of the present invention will be better understood in view of the following description taken in conjunction with the drawings wherein.

Figure 1:
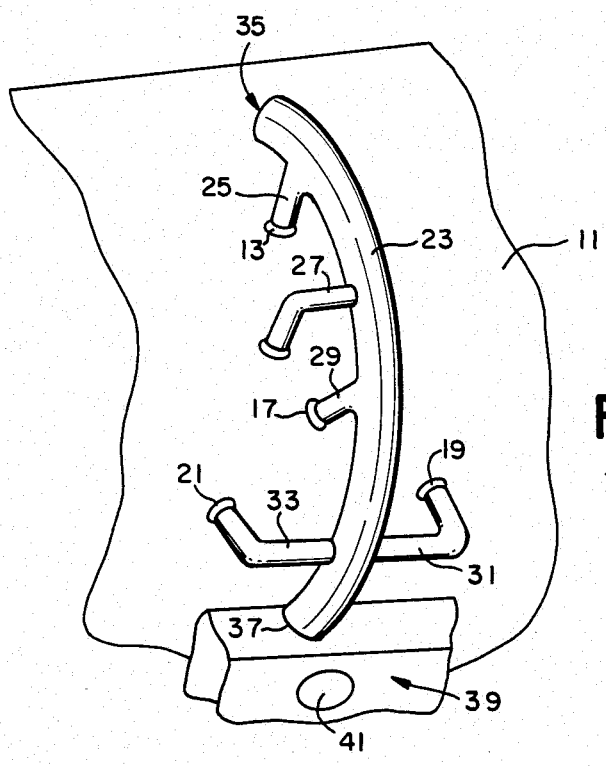
FIG. 1 PRIOR ART
FIG. 1 is a pictorial showing the prior art pipe arrangement.

Consider FIG. 1 which depicts a cooling structure of the prior art. In FIG. 1, there is shown a section 11 of the outside wall of a hot zone enclosure. Note that in the section 11, there are found five holes 13, 15, 17, 19 and 21. As also can be seen in FIG. 1, there is a main pipe 23 with offshoot pipes 25, 27, 29, 31 and 33 formed integrally therewith. The main pipe 23 is sealed off at end 35, while open end 37 is fitted into a manifold means 39. In the prior art, the practice is to mount six or more main pipes in parallel, by some mounting means, and to mount said main pipes in close proximity to the wall 11 of the hot zone chamber. The prior art arrangement involved having the offshoot pipes each located to enter an associated aperture in the wall of the hot zone chamber. For instance, as can be understood from FIG. 1, offshoot pipe 25 passes through hole 13, offshoot pipe 27 passes through aperture 15, offshoot pipe 29 passes through aperture 17, offshoot pipe 31 passes through aperture 19, and offshoot pipe 33 passes through aperture 21. The open ends of such main pipes are connected into a manifold means such as manifold means 39. The inert gas is fed from a large duct, not shown, in response to a rotary pump, or the like, through the hole 41 and on through the main pipes and offshoot pipes into the hot zone enclosure.

In the hot zone enclosure, there always exists a plurality of heating elements, heating element holders, as well as the spouts or pipes just described. Due to the stresses in such members by the constant change of temperature, these members become brittle and rupture. A broken member of course has to be repaired and often it is necessary to remove the hot zone enclosure to make such repairs.

It has been found that the removal of the main pipe in the prior art, such as pipe 23, with all the offshoot pipes, is difficult and time consuming. Even more serious than the foregoing, is the fact that the offshoot pipes per se become brittle and in removing the pipe assembly, the offshoot pipes often break, which mandates that the entire pipe assembly must be replaced. In addition, because of the configuration of the pipe assembly, there are pressure losses as gases pass therethrough and such losses result in an uneven distribution of gases into the hot zone chamber.

Figure 2:
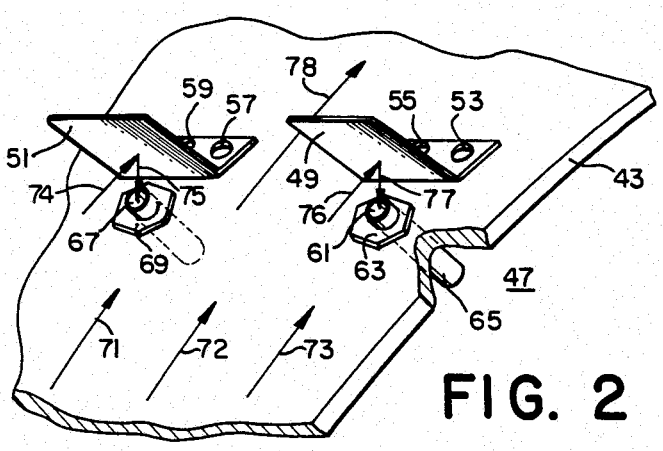
FIG. 2 is a pictorial showing the relationship between two baffles and two apertures.
Figure 3:
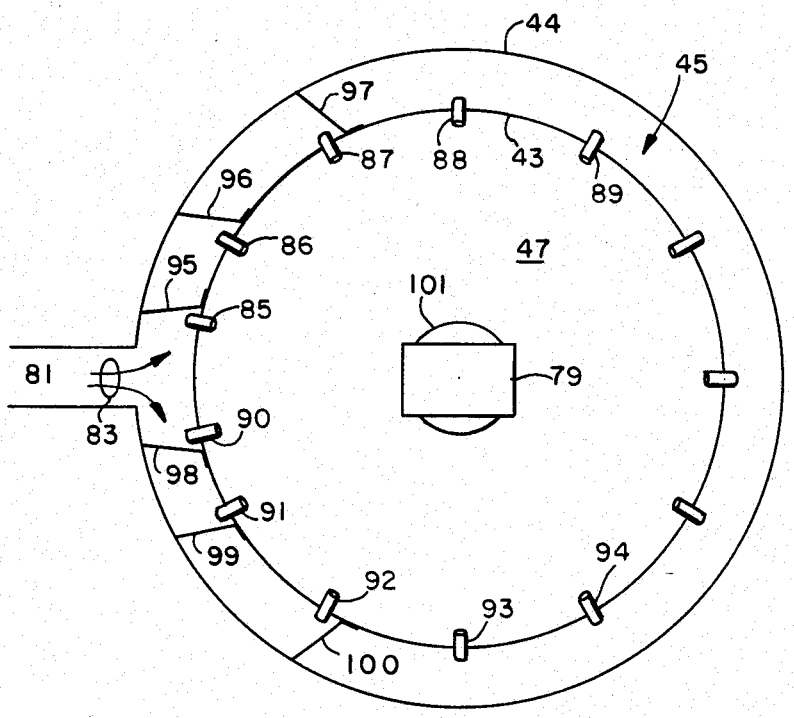
FIG. 3 is an end-view schematic of an embodiment of the plenum depicting the relationship of some baffles and some nozzles.

Consider FIG. 2 which depicts a structure in accordance with the present invention. In FIG. 2 there is shown a section of the common wall 43 which lies between the plenum and the hot zone chamber of the vacuum furnace. The common wall 43 and its significance as being a common wall between the plenum and the hot zone chamber can be better understood by looking at FIG. 3. In FIG. 3, the common wall 43 is shown lying between the plenum 45 and the hot zone chamber 47. If we once again look at FIG. 2, we find that secured to the common wall 43 are two baffles 49 and 51. The baffles 49 and 51, in the preferred embodiment, are made from molybdenum, although other forms of rigid materials could be used. The baffle 49 is fastened to the common wall 43 by virtue of the screws 53 and 55, while the baffle 51 is fastened to the common wall 43 by virtue of the screws 57 and 59. Although the baffles are shown fastened to the common walls with screws, other forms of securing means such as welding, etc. could be employed. As can be gleaned from FIG. 1, in front of the baffle 49, there is located a nozzle 61, which passes through an aperture in the common wall 43 and, as can be seen on the other side of that common wall, the nozzle 61 faces into the hot zone chamber 47. The nozzle 61 is held in position by a nut 63, which is welded to the common wall 43. The nozzle 61 could be secured to the common wall 43 in a number of ways, for instance, by having a nut such as nut 63 on the underside of the common wall and threaded onto the nozzle 61 or by cutting a thread in the aperture in the common wall and cutting a thread on the nozzle and simply having the nozzle threaded into the common wall. The common wall 43 is broken away (in section 65) so that the nozzle 61 can be seen in the hot zone chamber 47. Also as can be seen in FIG. 2, there is a nozzle 67 disposed in front of the baffle or gas deflecting member 51. The nozzle 67 is held in position by a welded nut 69 and the nozzle is shown in phantom as passing through the wall 43.

When inert gas is passed through the plenum in an arrangement which is more completely depicted in FIG. 3, the inert gas will be traveling upward in the drawing of FIG. 2, as shown by the arrows 71, 72 and 73. The inert gas traveling along the path 71 will strike the baffle 51 as shown by the arrow 74 and then be deflected therefrom as depicted by the arrow 75 into the nozzle 67. It should be understood that there is a great pressure difference between the gas in the plenum 45 and the vacuum situation in the hot zone chamber 47. Accordingly, when the gas is deflected from the baffle, as depicted by the arrows 74 and 75, there is great incentive for the gas to pass through nozzle 67 into the hot zone chamber 47. The gas, which is passing along the path depicted by the arrow 72, passes between the baffles 49 and 51, while the gas passing along the path depicted by the arrow 73 strikes the baffle 49 and, as shown by the arrow 76, is deflected therefrom (as shown by the arrow 77) into the nozzle 61. Actually, the gas dynamics are far more complicated than as shown by these arrows and there is gas passing around the baffles 49 and 51 to load the space downstream from those baffles. In addition, the gas that is depicted as passing along the path 78 is also spreading into sections of the plenum downstream from the baffles 49 and 51. However, it should be understood that the deflection process is in effect and does provide a gas build-up for the nozzles 61 and 67. Hence, there results a uniform gas supply through the nozzles into the hot zone chamber 47.

Consider FIG. 3, which shows the relationship of the plenum 45, the common wall 43 and the hot zone 47. When the workpiece 79 is to be cooled, which means that the hot zone chamber is to be filled with inert gas, the inert gas is loaded through the pipe 81 into the plenum 45. Inert gas travels into the plenum as depicted by the arrow 83, under relatively high pressure and at very high speed. It should be understood that prior to the inert gas being loaded into the plenum 45, the plenum is in a vacuum condition or very close to vacuum because as the hot zone chamber 47 is "pumped down" to a vacuum condition, any gases which might be in the plenum 45 are also removed.

The gas coming into the plenum 45 travels around that plenum and constantly exerts force against each of the nozzles, such as nozzles 85 through 94. Through a series of tests, I determined that because the gas does enter the plenum at such high pressures and at such high velocities, very often the gas passes over the initial nozzles such as nozzles 85, 86, 87, 90, 91 and 92 without passing as much of such gas through those nozzles as is passed through the nozzles 88, 89, 93 and 94. I further determined that if baffles are placed part way around the plenum, such as depicted by the baffles 95 through 100, that the gas will strike those baffles and build up the gas supplies thereat. Accordingly, there will be a generous flow of gas through the nozzle openings in the plenum associated with the baffles, so that approximately the same amount of gas that is supplied through, for instance nozzle 89, will also be supplied through nozzle 85. To say it another way, the gas flowing into the plenum is sufficiently slowed down by the baffles that there is more incentive for it, or a portion of it, to pass through an initial nozzle into the low pressure of the hot zone chamber than to seek the low pressure condition which is present when the plenum is in a vacuum condition or not filled with gas. In accordance with the foregoing description, the gas distribution into the hot zone chamber can be made to be uniform so that if the workpiece 79 needs a truly uniform gas cooling effect, it is available through the arrangement shown in FIG. 3.

It should be noted in FIG. 3 that at the back of the vacuum furnace, shown behind the workpiece 79, there is an opening 101. When the system is in a quench mode, or in a cooling mode, the inert gases which pass through the nozzles into the hot zone chamber 47 are withdrawn from that hot zone chamber through the opening 101 and are pumped through a heat exchanger and sent back into the pipe 81. In a preferred embodiment, the baffles are placed 20% around the periphery of the hot zone chamber. It should be understood that depending upon the pressure of the gas flowing through the pipe 81 and the speed of that gas and the size of the plenum, the numbers of baffles that are used will differ and the requisite number can be readily determined empirically.

Figure 4:
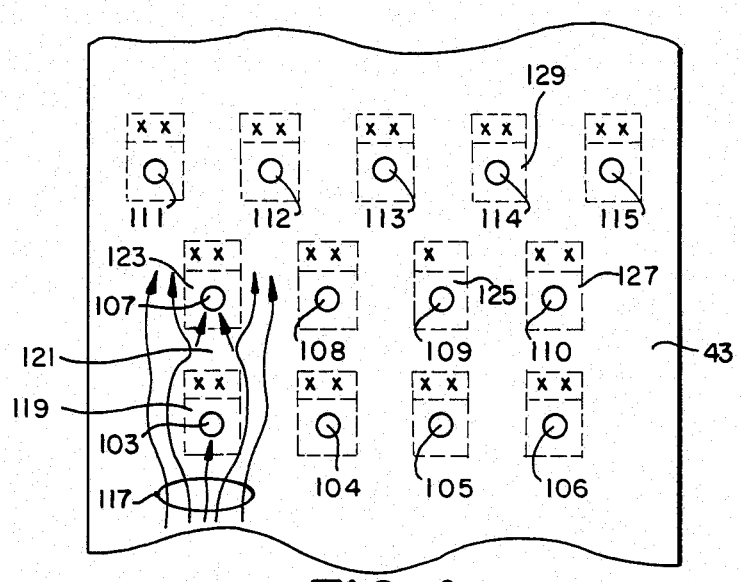
FIG. 4 is a section of the common wall between the plenum and the hot zone "rolled out" to depict two different arrangements of apertures and baffles.

FIG. 4 shows a section of the common wall 43 "rolled out". As can be seen in FIG. 4, there are a number of apertures, 103 through 115, formed in the common wall 43. It should be understood that into each of the apertures 103 through 115 there will be located a nozzle which will be secured to the common wall as described in connection with FIG. 2. Also, as can be seen in FIG. 4, over each of the apertures 103 through 115, there is located a baffle which is depicted in phantom and which is secured to the common wall by screws which are represented by the small "x's".

The arrangement of the apertures 103 through 106, with respect to the apertures 107 through 110, represents one arrangement of apertures and baffles that operates within the spirit of the present invention. If the apertures are formed in the common wall, one behind the other, as is true with the arrangements of the apertures 103 through 106, vis a vis the apertures 107 through 110, then gases flowing through the plenum will pass between the baffles and will spread out to fill the space between the rows as depicted by the arrows 117. To say it another way, if the inert gas is passing upward in the drawing, then the gas (or a portion of the gas) represented by the center arrow heading toward the aperture 103 strikes the baffle 119, causes a gas build-up at that point, and passes through the aperture 103. Other gases which may strike other portions of that baffle, or be forced therearound by the gas build-up, will pass around that baffle and fill the next space 121 to approach the aperture 107 and the baffle 123. Actually, the gas dynamics are more complicated than that depicted by the arrows 117, but the end results are properly represented by the arrows 117. It should be understood that the same gas phenomena applies to the entire two rows of apertures presently under discussion.

In a second arrangement, we find that the apertures 107 through 110 are staggered with respect to the apertures 111 through 115. Accordingly, the gases which pass, for instance, between the baffles 125 and 127 head for the baffle 129 and strike it to provide a build-up of gas thereat and thus provide gas through the aperture 114. Both forms of aperture arrangements have been found to be satisfactory, and an aperture arrangement with the baffles in either configuration is within the spirit of this invention.

Figure 5:
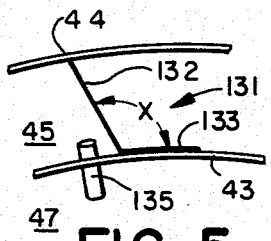
FIG. 5 depicts one baffle in a substantial "L" arrangement.

In FIG. 5, there can be seen a baffle 131 which has a rising section 132 and a secured section 133. The secured section 133 is secured to the common wall 43 as described earlier, and the rising section goes to the top of the plenum ending in close proximity to the upper wall 44 of the plenum 45. The nozzle 135 is shown to provide an appreciation of the relationship between the nozzle and the angle of its associated baffle. As can be gleaned from FIG. 5, there is an angle "X" which lies between the secured section and the rising section of the baffle 131. In a preferred embodiment, the angle "X" is 120°, although other suitable angles could be used.

Figure 6:
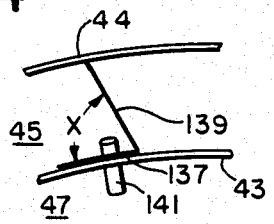
FIG. 6 shows a second arrangement of a baffle in a substantial "J" arrangement.

In FIG. 6, there is shown another version of the baffle. The baffle in FIG. 6 has a secured section 137 and a rising section 139. The secured section 137 is located to lie in the direction from whence the gas would be coming, while the baffle in FIG. 5 has the secured section located to lie in the direction toward which the gas is traveling. In FIG. 6, the rising section 139 also goes substantially to the top of the plenum chamber and comes in close proximity to the upper wall 44. The angle "X" shown in FIG. 6, in the preferred embodiment, is 60°, but it should be understood that other angles may be used. Nozzle 141 is shown in FIG. 6 to provide an appreciation of the relationship between the nozzle and the angle of its associated baffle. It should be noted that the nozzle 141 passes through an aperture in the secured section of the baffle, as well as through the aperture in the wall 43.

The present invention is an improvement on the structure that I described and claimed in my U.S. Pat. No. 4,395,832. The structure described in my U.S. Pat. No. 4,395,832 operates reasonably satisfactorily and does provide good heat transfer, uniformity of gas flow, and reduced maintenance problems, as was indicated in that description. However, in the course of testing the plenum device, it was determined that, under certain circumstances of initial pressure and velocity, the inert gas flow into the hot zone chamber and directed at the workpiece, was not as uniform as it was under certain other circumstances of initial pressure and velocity. Accordingly, the problem was worked on and it was discovered that if a limited number of baffles were put into the plenum to intercept, for deflection purposes, the inert gas in some segment of its initial flow, that said inert gas would be provided to the hot zone chamber with a higher degree of uniformity than in the prior art, irrespective of the initial gas pressure and velocity.

I claim:

1. A plenum to be used with a hot zone chamber of a vacuum furnace wherein said hot zone chamber has an outer wall, and wherein said plenum is formed to provide inert gas into said hot zone chamber comprising in combination: chamber means having an upper wall, first and second side walls, and a lower wall, said upper wall and said lower wall being secured in a sealed fashion to said first and second side walls to thereby define a sealed chamber within said walls; said lower wall being formed integral with said outer wall of said hot zone chamber and further formed to have a plurality of apertures opening into said hot zone chamber; a plurality of deflecting means with each having first and second sections and with each said first section secured to said lower wall and each said second section forming an angle with its associated first section and formed to rise from said lower wall toward and be in close proximity to said upper wall, each of said deflecting means further disposed to lie away from an adjacent deflecting means by at least the width of a deflecting means, said plurality of deflecting means being disposed along the peripheral length of said lower wall at a lesser distance than the full peripheral length of said lower wall; and said apertures lying in rows substantially parallel to the axis of said hot zone chamber and wherein said deflecting means are disposed in rows lying substantially parallel to the axis of said hot zone chamber.

* * * * *